US005142992A

United States Patent [19]

Long, Jr.

[11] Patent Number: 5,142,992

[45] Date of Patent: Sep. 1, 1992

[54] CRANE SECUREMENT LATCH

[75] Inventor: Herbert D. Long, Jr., West Allis, Wis.

[73] Assignee: Harnischfeger Corporation, Brookfield, Wis.

[21] Appl. No.: 572,287

[22] Filed: Aug. 27, 1990

[51] Int. Cl.[5] ..... B61K 7/06

[52] U.S. Cl. ..... 104/251; 104/254

[58] Field of Search ..... 104/249, 250, 251, 254; 188/31, 60; 212/205, 218, 222

[56] References Cited

U.S. PATENT DOCUMENTS

| | | | |
|---|---|---|---|
| 809,483 | 6/1905 | Whittemore | 212/205 X |
| 3,696,756 | 10/1972 | Elmore et al. | 104/251 |
| 3,710,728 | 1/1973 | Levitt | 104/251 |
| 4,453,469 | 6/1984 | Bedford | 104/250 X |

FOREIGN PATENT DOCUMENTS

| | | | |
|---|---|---|---|
| 14126 | 4/1897 | Switzerland | 104/249 |

*Primary Examiner*—Robert J. Oberleitner
*Assistant Examiner*—Kevin D. Rutherford
*Attorney, Agent, or Firm*—Richard C. Ruppin

[57] ABSTRACT

A latch for a crane travelable along a pair of generally parallel rails and having an overhead frame and a plurality of wheels engaging both of the rails for supporting the crane during its travel on the rails. The latch comprises a latch arm mounted on the crane and having a path of movement substantially in the direction of travel of the crane. The latch arm also includes a transversely projecting hook. A latch block is stationarily mounted and has a lip member projecting into the path of movement of the latch arm. The hook on the latch arm moves with the latch arm into engagement with the lip member and the lip member and hook have an engaged position in which the lip member is positioned between the hook and the crane whereby the crane is held from traveling away from the latch block. The latch may also include a compressible bumper mounted on the crane and engaging the latch block compressively in the direction of the crane travel toward the latch block. The crane is thereby also held from traveling toward the latch block. A support is positioned below the latch arm when the hook and lip means are in their engaged position. The support is movable to an upward position beneath the latch arm to support the latch arm in an upward position in which the hook and lip member are disengaged.

11 Claims, 2 Drawing Sheets

CRANE SECUREMENT LATCH

FIELD OF THE INVENTION

This invention relates to a latch arrangement for securement of a crane. More particularly, the invention relates to a latch positioned adjacent ground level for securing a portal crane at a stationary parked location.

BACKGROUND OF THE INVENTION

When a crane is not in use, it is often desired to secure it to prevent movement that may result in either damage to other objects or damage to the crane itself. This is particularly true of cranes that are located out of doors and are subject to wind forces that move them on their tracks from a parked position. A type of crane which is especially subject to wind movement is a portal crane which, by its nature, has considerable surface area which may be subjected to wind forces.

When a crane is not in use, the electrical power to it is normally turned off and, therefore, electrically operated brakes are not available to maintain the crane stationary. Mechanical parking brakes may be used, however, these add undesired complexity and maintenance to the crane. A further problem with brakes used to secure a crane while it is not in use is that when it is desired to return the crane to service, the operator may be located remotely from the brake and its release mechanism, for example, where a mechanical brake is used. There is, consequently, a need for a crane parking brake which is operable irrespective of the remote location of the crane operator, which is not dependent on electrical power, and which is simple and maintenance free.

SUMMARY OF THE INVENTION

It is a general object of this invention to provide a latch arrangement for securing a crane at a stationary parked location. It is a further object of the invention to provide a crane securement latch which can be unlatched to release the crane at the location of the latch mechanism and can be automatically relatched by movement of the crane to the parked location.

The invention is accomplished by providing a latch for a crane travelable along a pair of generally parallel rails and having an overhead frame and a plurality of wheels engaging both of the rails for supporting the crane during its travel on the rails. The latch comprises a latch arm mounted on the crane and having a path of movement substantially in the direction of travel of the crane. The latch arm also includes a transversely projecting hook. A latch block is stationarily mounted and has a lip member projecting into the path of movement of the latch arm. The hook on the latch arm moves with the latch arm into engagement with the lip member and the lip member and hook have an engaged position in which the lip member is positioned between the hook and the crane whereby the crane is held from traveling away from the latch block.

Support means may be positioned below the latch arm when the hook and lip means are in their engaged position. The support means is movable to an upward position beneath the latch arm to support the latch arm in an upward position in which the hook and lip means are disengaged.

The latch may also include a compressible bumper mounted on the crane and engaging the latch block compressively in the direction of the crane travel toward the latch block. The crane is thereby also held from traveling toward the latch block.

BRIEF DESCRIPTION OF THE DRAWINGS

Further objects and advantages of the invention will appear when taken in conjunction with the accompanying drawings, in which.

DETAILED DESCRIPTION OF THE INVENTION

Figures 1, 8:
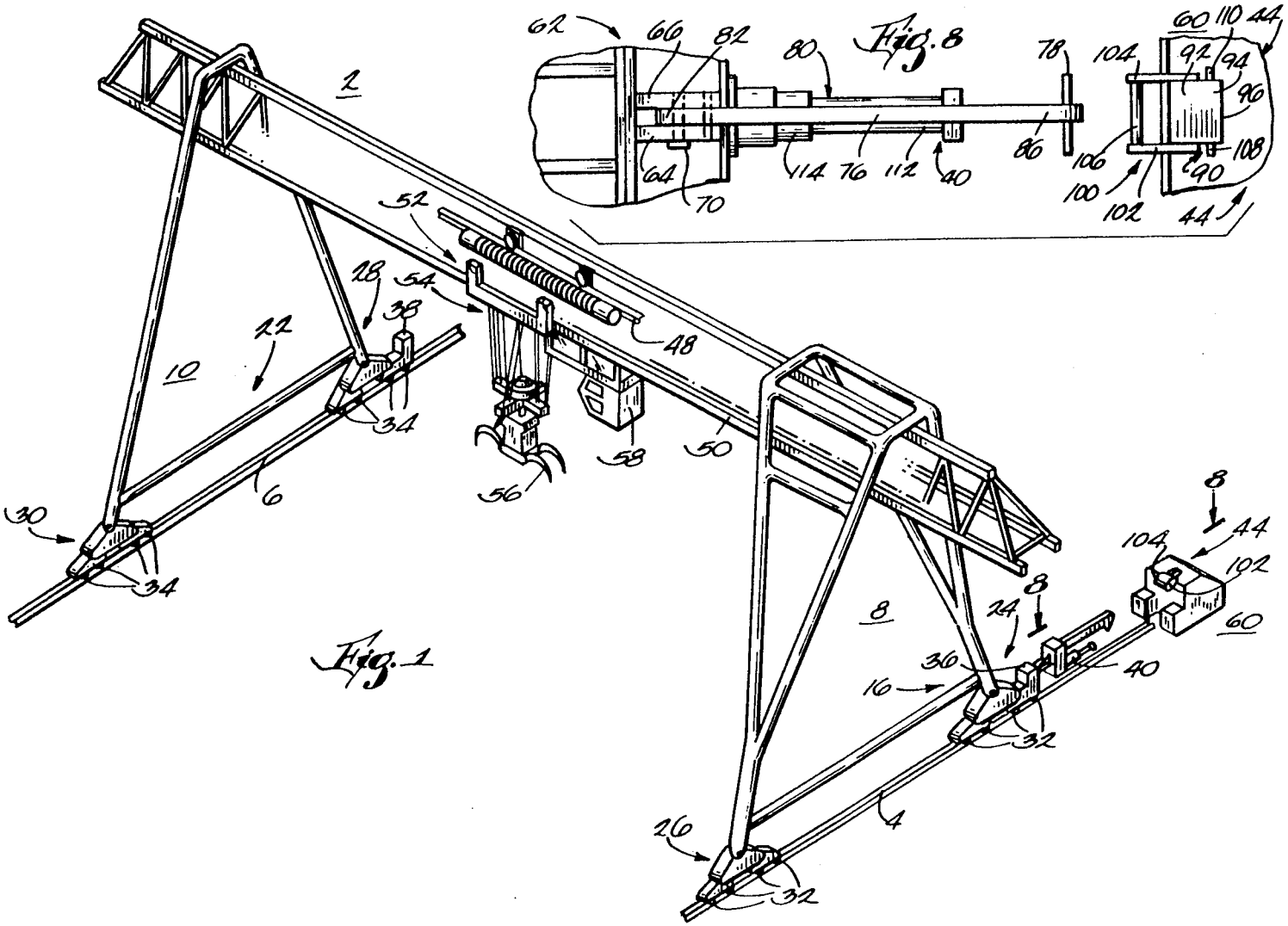
FIG. 1 is a perspective view of a portal type gantry crane incorporating the securement latch according to the invention.
FIG. 8 is a top plan view showing the latch.
Figure 2:
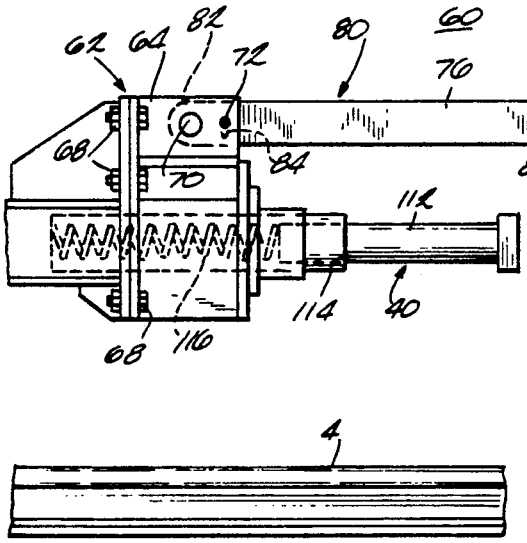
FIG. 2 is a side-elevation view of the portion of the latch mounted on the crane.
Figure 3:
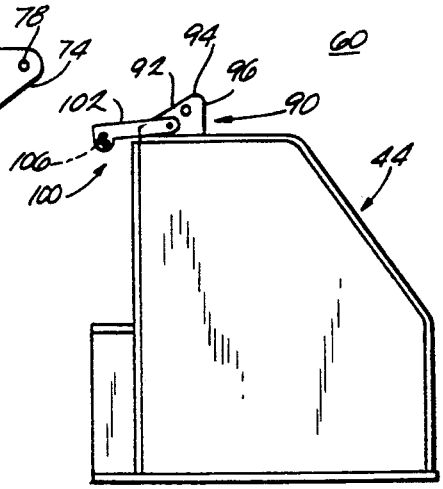
FIG. 3 is a side-elevation view of a stationary portion of the latch positioned for engagement with the portion of the latch shown in FIG. 2.

Referring generally to FIGS. 1–3 of the drawing, a portal crane is illustrated as having a frame 2 disposed generally horizontally and overlying two generally parallel rails 4 and 6 and also having two spaced apart legs 8 and 10 affixed to the frame 2 and respectively extending between the frame and the rails 4 and 6. The rails 4 and 6 are laid in a material storage area, such as a log yard, in which logs are stored prior to their use for paper or other wood products. The leg 8 has a lower base end 16 and the leg 10 has a lower base end 22. The base ends 16 and 22 respectively include a pair of spaced apart wheel truck assemblies 24, 26 and 28, 30. The truck assemblies 24 and 26 include wheels 32 and engage and ride on the rail 4, and the truck assemblies 28, 30 include wheels 34 and engage and ride on the rail, thus permitting the portal crane to travel along the rails 4 and 6 through the material storage area. Motors 36 and 38 provide power to a portion of the wheels 32 and 34 to drive the crane along the rails.

A bumper 40 is mounted on the truck assembly 24 and includes a spring 116 mounted within a cylinder 114 and a bumper rod 112 extending in the direction of travel of the crane. The rod extends into the cylinder 114 and bears against the spring 116 such that the rod 112 applies compressive force against an end stop 44 at the end of the rail 4 when the crane travels to the end of the rails.

A pair of parallel tracks 48 and 50 are affixed to the frame 2 and support a trolley 52 for travel along the length of the frame 2. A hoist 54 is mounted on the trolley 52 and includes a grapple hook 56 for raising and lowering a load of material such as the logs which are to be stored in or removed from the storage area, and holding the material as the trolley 52 moves along the tracks 48 and 50, and the crane moves along the rails 4 and 6. An operator's cab 58 is suspended from the trolley 52.

With reference to FIGS. 2–8, a securement latch 60 is shown as having a latch base 62, a latch arm 80, a latch block 90, and a latch arm release support 100. The latch base 62 is affixed to the truck assembly 24 by suitable means, such as a plurality of bolts and nuts 68, and includes a pair of spaced apart support walls 64 and 66 for supporting the latch arm 80. The latch arm 80 is positioned extending generally in the direction of travel of the crane along the parallel rails 4 and 6 and toward the latch block 90. In this position, the latch arm 80 has a path of movement substantially in the same direction as the travel of the crane. The latch arm 80 has a pivoted end 82 positioned between the support walls 64 and 66 and pivotally mounted on the support walls by a pivot pin 70 extending through the support walls and through the pivoted end 82 of the arm 80. The arm 80 further includes a travel limit slot 84 through which a travel limit pin 72 extends. The travel limit pin 72 is mounted on the wall 64 and 66 and spans the space between the two walls. The pin 72 and slot 84 limit the pivotal movement of the arm 80 from a downward position in which the pin 72 engages an upper end of the limit slot 84, as shown in FIG. 2, to an upward position in which the limit pin engages a lower end of the travel limit slot 84. The latch arm 80 further includes a hook end 86 having a lift handle 78, and a hook 88. The hook 88 includes an inclined end face 74 and projects transversely to the length 76 of the arm 80 in a downward direction in the views of FIGS. 2 and 4–7.

Figure 4:
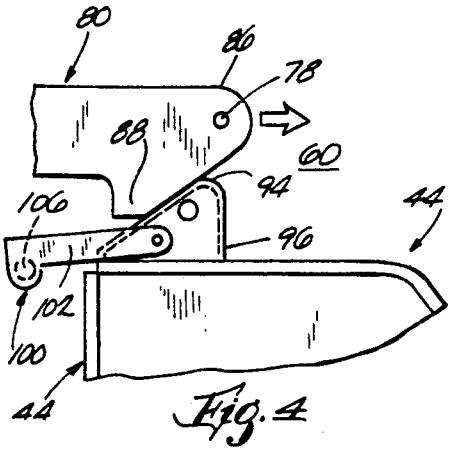
FIG. 4 is a side-elevation view showing portions of the latch in engagement with each other prior to moving to a latched position.

The latch block 90 includes the end stop 44, both stationarily mounted, and further includes a ramp 92 inclined at an angle upwardly and away from the movement of the latch arm 80 towards the ramp, a side 96 facing away from the ramp 92, and a lip 94 at the upper end of the ramp 92 and connecting the ramp 92 and the side 96. The angle of the ramp surface 92 may be the same as that of the inclined end face 74 of the hook end 86 at the position of their initial engagement as the arm 80 moves towards the latch block 90. The latch arm release support 100 is pivotally mounted on latch block 90 and includes a pair of pivoted arms 102, 104 and a support rod 106 spanning and connected between the arms 102 and 104. The release support 100 has a downward position as shown in FIGS. 3–5 in which the support rod 106 is positioned below the ramp 92, and an upward position shown in FIG. 6 in which the release support 100 is supported by pins 108 and 110 at a small angle a from the vertical in the direction of movement of the latch arm 80 along its path of travel toward the latch block 90.

Figure 5:
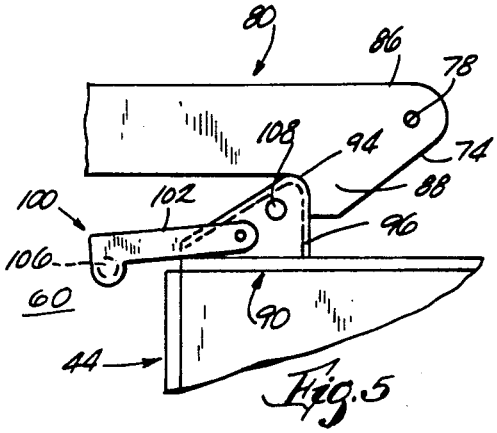
FIG. 5 is a side-elevation view of the portions of the latch in a latched position.
Figure 6:
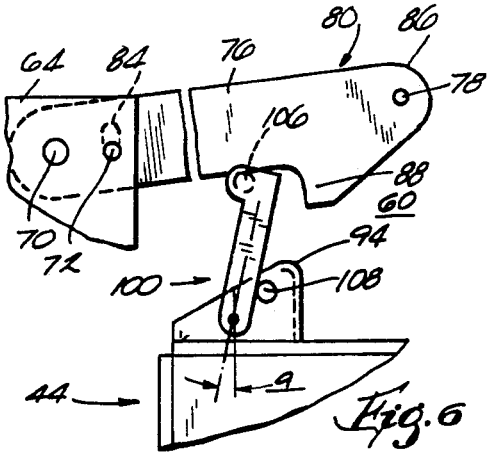
FIG. 6 is a side-elevation view showing the latch in an unlatched position with the portion of the latch mounted on the crane positioned above the stationary portion of the latch prior to the movement of the portion of the latch mounted on the crane away from the stationary portion of the latch.
Figure 7:
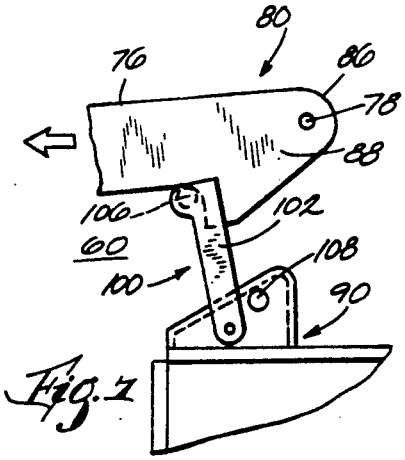
FIG. 7 is a side-elevation view showing the latch portion mounted on the crane as it moves away from the stationary latch portion and moves a release support arm toward a downward position.

When the crane is in a parked and secured position, the securement latch 60 will be in the position as shown in FIG. 5 in which the latch arm 80 extends substantially horizontally towards the latch block 90, and the hook 88 is in a latched position in which the hook engages the lip 94 and extends downward along the lip 94 and against the side 96. The latch arm release support 100 is in its downward position as shown in FIGS. 3–5. The bumper rod 112 is in engagement with the end stop 44 and is slightly retracted within the cylinder 114 so that the bumper rod 112 maintains compressive force against the end stop 44 of the latch block 90 in the direction of crane travel or movement toward the latch block. Due to the engagement of the hook 88 about the lip 94 and against the side 96, the crane is prevented from moving in a direction away from the latch block 90 and its end stop 44. Due to the compressive force of the bumper rod 112 against the end stop 44, the crane is restrained from moving toward the end stop 44. Thus, the crane is prevented from movement along the rails 4 and 6 while parked and latched due to wind or any other forces acting on the crane.

When it is desired to unlatch the crane in preparation for its return to service, the crane operator, prior to his climbing up to the cab 58, may lift the latch arm 80 by use of the lift handle 78 and pivot the latch arm release support 100 to its upward position beneath the latch arm. The release support 100 is positioned at the slight angle a from the vertical against the release support pins 108, 110 and the latch arm 80 is rested on the support rod 106 so that the release support 100 supports the arm 80 in an upward position and prevents it from moving downward and engaging the latch block 90. While the latch arm 80 is thus supported, the operator may climb up to the cab 58, start the drive motors 36, 38 and move the crane away from the end stop 44. The latch arm 80 then moves along its path of travel away from the area of the latch block 90 and the end stop 44. As the latch arm 80 does so, the friction force of its engagement with the release support 100 will cause the release support to pivot towards its downward position and drop by virtue of its own weight to the downward position as the latch arm 80 continues moving away from the end stop 44. This movement of the release support 100 removes it from the path of movement of the latch arm 80 toward the latch block 90 so that the release support 100 will not interfere with movement of the latch arm 80 when it later returns to engage the latch block 90 and latch the crane in a parked position.

When the operator desires to again park and latch the crane, he drives it toward the end stop 44 so that the arm 80 moves along its path of travel toward the latch block 90, above the release support 100 in its downward position, to a position in which the hook end face 74 engages and slides against the ramp 92 and over the lip 94 so that the hook end 86, lip 94 and side 96 again latch the crane. At the same time, the bumper rod 112 engages the end stop 44 to prevent excessive impact of the end stop 44 by the crane and provide compressive force generally in the direction of the latch block and end stop to cooperate with the hook to hold the crane relatively firmly in the parked position.

It will be understood that the foregoing description of the present invention is for purposes of illustration only, and that the invention is susceptible to a number of modifications or changes, none of which entail any departure from the spirit and scope of the present invention, as defined in the hereto appended claims.

What is claimed is:

1. A latch for a crane travelable along a pair of generally parallel rails and having an overhead frame and a plurality of wheels engaging both of the rails for supporting the crane during its travel on the rails, comprising:

a latch arm pivotally mounted for vertical movement on the crane, the latch arm having a path of movement and being movable along said path substantially in the direction of travel of the crane, the latch arm having a downward projecting hook;

a stationary latch block having an upward projecting lip member positioned in the path of movement of the latch arm, the lip member and hook having an engaged position such that the crane is held from moving away from the latch block and a disengaged position in which the hook overlies the latch block whereby the crane can be moved away from the latch block; and support means having a position below and spaced from the latch arm in said engaged position of the hook and movable to an upward position beneath and engaging the latch arm for supporting the latch arm in an upward position and the hook in said disengaged position.

2. The latch according to claim 1 wherein said spaced position of the support means is out of said path of movement of the latch arm as the latter moves toward the lip member whereby the support means does not interfere with the movement of the hook into its engagement with the lip member.

3. The latch according to claim 2 wherein the support means comprises a link pivotal from said spaced position out of the path of movement of the latch arm to said upward position in the path of movement of the latch arm and supporting the latch arm in said upward position.

4. The latch according to claim 1 wherein the support means comprises link means pivotal to an upright position for holding the latch arm in said upward position and pin means positioned at an angular distance from the vertical and engaged by the link means in the upright position of the latter for supporting the link means in the upright position.

5. The latch according to claim 4 wherein said angular distance from the vertical is in the direction of movement of the latch arm toward the latch block.

6. The latch according to claim 2 wherein the support means is movable from the upward position to the spaced position below the latch arm in response to movement of the latch arm along its path of movement away from the latch block whereby the support means does not interfere with subsequent movement of the latch arm along its path of movement toward the latch block.

7. The latch according to claim 1 wherein:

the lip member has a position between the hook and the crane when the lip member and the hook are in their engaged position, whereby the crane is held from moving away from the latch block; and further comprising a compressible bumper mounted on the crane and having a position out of the path of movement of the latch arm and engaging the latch block compressively in the direction of the lip member whereby the crane is held from moving toward the latch block and, due to the holding of both the lip member and hook and the bumper, the crane is held stationary and latched.

8. A latch for a crane travelable along a pair of generally parallel rails and having an overhead frame and a plurality of wheels engaging both of the rails for supporting the crane during its travel on the rails, comprising:

a latch arm mounted on the crane and having a path of movement substantially in the direction of travel of the crane, the latch arm having a transversely projecting hook;

a stationary latch block having a lip member projecting into the path of movement of the latch arm, the lip member and hook having an engaged position in which the lip member is positioned between the hook and the crane whereby the crane is held from traveling away from the latch block; and a compressible bumper mounted on the crane and having a position out of the path of movement of the latch arm in engagement with the latch block compressively in the direction of the crane travel toward the latch block whereby the crane is held from traveling toward the latch block and, due to the holding of both the lip member and hook and the bumper, the crane is held stationary and latched.

9. The latch according to claim 8 wherein:

the lip member and hook have a disengaged position in which the hook is spaced from the lip member; and support means mounted on the latch block and movable from a first position out of the path of movement of the latch arm to a second position in said path of movement and engaging the latch arm for supporting the hook in said disengaged position whereby the crane may be moved away from the latch block.

10. The latch according to claim 9 wherein the support means is movable from said second position to the first position in response to movement of the latch arm along its path of movement away from the latch block whereby the support means does not interfere with subsequent movement of the latch arm along its path of movement toward the latch block.

11. The latch according to claim 10 wherein the support means is responsive to friction force of the latch arm during movement of the latter in moving to said first position.

* * * * *